US009865116B2

(12) United States Patent
Su

(10) Patent No.: US 9,865,116 B2
(45) Date of Patent: Jan. 9, 2018

(54) METHOD FOR VERIFYING A VALUABLE DOCUMENT HAVING A POLYMER SUBSTRATE AND A TRANSPARENT WINDOW AND MEANS FOR CARRYING OUT SAID METHOD

(71) Applicant: GIESECKE & DEVRIENT GMBH, München (DE)

(72) Inventor: Shanchuan Su, Neubiberg (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 46 days.

(21) Appl. No.: 15/023,792

(22) PCT Filed: Sep. 25, 2014

(86) PCT No.: PCT/EP2014/002606
§ 371 (c)(1),
(2) Date: Mar. 22, 2016

(87) PCT Pub. No.: WO2015/043751
PCT Pub. Date: Apr. 2, 2015

(65) Prior Publication Data

US 2016/0232732 A1 Aug. 11, 2016

(30) Foreign Application Priority Data

Sep. 27, 2013 (DE) ..... 10 2013 016 120

(51) Int. Cl.
*G07D 7/12* (2016.01)
*G07D 7/06* (2006.01)

(52) U.S. Cl.
CPC ..... *G07D 7/12* (2013.01); *G07D 7/06* (2013.01)

(58) Field of Classification Search
CPC ..... G07D 7/16
See application file for complete search history.

(56) References Cited

U.S. PATENT DOCUMENTS 4,516,031 A * 5/1985 Kaule ..... G07D 7/12 209/534
6,741,727 B1 * 5/2004 Hirasawa ..... G07D 7/12 356/71

(Continued)

FOREIGN PATENT DOCUMENTS

DE 102004036229 A1 2/2006
DE 102009057348 A1 6/2010

(Continued)

OTHER PUBLICATIONS

German Search Report from corresponding German Application No. 10 2013 016 120.7, dated Mar. 25, 2014.

(Continued)

*Primary Examiner* — Casey Bryant
(74) *Attorney, Agent, or Firm* — Justin J. Cassell; Workman Nydegger

(57) ABSTRACT

Described is a method for checking a value document having a polymer substrate and at least one see-through window, in which a digital transmission image of the value document is captured, the transmission image comprising pixels, in the image an edge brightness value for the brightness of an edge of the at least one see-through window is ascertained, using the edge brightness value, a threshold value for the recognition of a print removal is ascertained which is smaller than the edge brightness value but greater than the minimal brightness in the image, it is checked whether pixels which lie in at least one specified portion of the image and outside the at least one see-through window and its edge have a brightness which lies above the threshold value.

14 Claims, 3 Drawing Sheets

(56) References Cited

U.S. PATENT DOCUMENTS

| | | | |
|---|---|---|---|
| 2004/0131242 | A1 | 7/2004 | Klevtsov |
| 2014/0352441 | A1 | 12/2014 | Domke et al. |

FOREIGN PATENT DOCUMENTS

| | | | |
|---|---|---|---|
| DE | 102009032227 | A1 | 1/2011 |
| WO | 2013091856 | A1 | 6/2013 |

OTHER PUBLICATIONS

International Search Report from corresponding PCT Application No. PCT/EP2014/002606, dated Jan. 13, 2015.
International Preliminary Search Report on Patentability from corresponding PCT Application No. PCT/EP2014/002606, dated Mar. 29, 2016.

* cited by examiner

METHOD FOR VERIFYING A VALUABLE DOCUMENT HAVING A POLYMER SUBSTRATE AND A TRANSPARENT WINDOW AND MEANS FOR CARRYING OUT SAID METHOD

BACKGROUND

The present invention relates to a method for checking a value document having a polymer substrate and at least one see-through window as well as means for carrying out the method.

In this context, value documents are understood to mean sheet-shaped objects, which represent for example a monetary value or an authorization and thus shall not be manufacturable at will by unauthorized persons. They hence have features that are not simple to manufacture, in particular to copy, whose presence is an indication of authenticity, i.e. of manufacture by an authorized body. Important examples of such value documents are coupons, vouchers, checks and in particular bank notes.

The invention relates to checking a certain kind of value documents, namely those having a polymer substrate and at least one see-through window.

The value documents have a polymer substrate, which is understood to mean that they have at least one polymeric layer which serves at least partially as a carrier. Preferably, these are polymer bank notes.

Value documents having such polymer substrates mostly have on the surface of the polymer substrate one or preferably several areally applied cover layers opaque in the visible wavelength region; the cover layer or the cover layers are frequently printed on. With this or these there shall be achieved, inter alia, an appearance like that of a paper value document. Further, the uppermost cover layer serves, inter alia, as a carrier for printing inks with which the value document is printed. The value document needs to have in the visible wavelength region only an opacity that is usual with paper value documents, however. In particular, the value document having the cover layers may still be very weakly light-transmissive.

The value documents to be checked or checked within the framework of the invention further have a see-through window, which hereinafter is understood to mean a region of the value document which is transparent or translucent to optical radiation in a specified wavelength region, preferably in the visible spectrum, and has no opaque, areally applied cover layer. The see-through window, if transparency or translucency are given, may be a really printed by halftone printing with a transparent or translucent printing ink or also with any other printing inks or a material employed for forming the cover layer.

The see-through window may have any form and is limited by at least one areal region formed by the one or the several cover layers.

A problem of such value documents lies in the fact that these may lose printing ink or parts of the opaque, areally applied cover layer at individual places in the course of their use or circulation. For example, the printing ink or the opaque layer may chip off at these places. Such a deviation from a new value document caused by loss of the opaque layer and/or, where applicable, the printing ink located thereon will be referred to as a print removal within the framework of the present invention.

Such places are faults of the value document and possibly lower its usability or fitness for circulation. It is hence desirable, that value documents can be checked for such print removals. But the check is not simple, because there may be considerable variations between different print batches.

SUMMARY

The present invention is hence based on the object of providing a method for checking a value document having a polymer substrate and a see-through window by means of which the cover layer can be readily checked for the presence of print removals, as well as of providing means for carrying out the method.

The object is achieved by a method for checking a value document having a polymer substrate and at least one see-through window, in which a digital transmission image of the value document is captured, the transmission image comprising pixels, in the transmission image an edge brightness value for the brightness of an edge of the at least one see-through window is ascertained, using the edge brightness value, a threshold value for the recognition of a print fault is ascertained which is smaller than the edge brightness value but greater than the minimal brightness in the transmission image, and pixels of the transmission image are searched which lie in at least one specified portion of the transmission image and outside the at least one see-through window and its edge and which have a brightness which lies above the threshold value.

The object is further achieved by an apparatus for checking a value document having a polymer substrate and at least one see-through window, with an evaluation device which is configured to execute a method according to the invention. In particular, the evaluation device may be configured to capture a digital transmission image of the value document, the transmission image comprising pixels, to ascertain in the transmission image an edge brightness value for the brightness of an edge of the at least one see-through window, using the edge brightness value, to ascertain a threshold value for the recognition of a print fault which is smaller than the edge brightness value but greater than the minimal brightness in the transmission image, and to search for pixels of the transmission image which lie in at least one specified portion of the transmission image and outside the at least one see-through window and its edge and which have a brightness which lies above the threshold value. The method according to the invention may in particular be carried out by means of the apparatus according to the invention.

For carrying out the method, the apparatus has the evaluation device. This may have a data processing device which, for example, may have a computer or at least one processor and/or at least one FPGA for processing the transmission image. The evaluation device may have a memory in which a computer program is stored, so that the evaluation device, preferably the data processing device executes the method according to the invention upon the execution of the computer program.

The object is hence also achieved by a computer program for execution by means of a data processing device, which has program code, upon the execution of which the data processing device executes a method according to the invention.

The object is further achieved by a physical data carrier which is readable by means of a data processing device and on which a computer program according to the invention is stored.

In the method, transmission images of the mentioned value documents are employed for the recognition of print removals in the mentioned value documents. The transmission images may be transmission images in a specified wavelength region of the visible spectrum, for example, in the green region. Preferably, the transmission images are transmission images in the infrared wavelength region, i.e. IR transmission images; the method then works particularly effectively. If the brightness of transmission image pixels which lie outside the see-through window and its edge exceeds the threshold value, this is an indication of the presence of a print removal. But it is difficult to define the threshold value for a plurality of value documents.

It was found that in the transmission image a see-through window has an edge with a particularly high intensity or brightness, probably caused by scattering, which is suitable for ascertaining the threshold value, so that variations between different print batches no longer play a great role. The edge is understood to be a region limiting the see-through window in the transmission image, which may have a width of one or several pixels.

In the method, first the digital transmission image is captured, which comprises pixels whose properties are described by pixel data. The transmission image describes in locally resolved fashion the intensity captured upon a transmission examination with visible light or preferably upon a transmission examination with IR or infrared radiation. In particular, the pixel data may comprise a value for a brightness which corresponds to the intensity of the captured transmission radiation.

In principle, it is sufficient that the digital image is only captured, for example respective pixel data are read or are received. The apparatus, preferably the evaluation device, may for this purpose have a suitable interface via which the digital image can be captured.

But preferably, in the method, the transmission image is captured by means of an optical transmission sensor. For this purpose, the apparatus further has preferably an optical transmission sensor for capturing a digital transmission image of the value document, which sensor is coupled to the evaluation device via a signal connection; the evaluation device is then configured to capture as a digital image an image of the transmission sensor. The transmission sensor may be, for example, a transmission sensor for capturing a transmission image in the visible wavelength region. Preferably, the optical transmission sensor comprises an optical transmission sensor for capturing a digital infrared transmission image of the value document or is such a sensor. The transmission sensor may in particular have a source for optical radiation in a specified visible wavelength region or infrared wavelength region and a receiver for optical radiation in the specified visible wavelength region or infrared wavelength region passing through the value document.

Further, in the method there is ascertained the edge brightness value for the brightness of an edge of the at least one see-through window.

The edge brightness value may be ascertained in different ways, depending on the embodiment of the method and depending on the value document type of the value document. The value document type is given at least by the kind of the value document, for example, cheque or bank note. With bank notes, the value document type is further given by the currency, face value or denomination and, optionally, the emission and/or the orientation in the transport path.

According to a first alternative, a maximum of the brightness of the pixels of the whole transmission image of the value document is ascertained as an edge brightness value. In the apparatus, the evaluation device is then preferably configured to ascertain a maximum of the brightness of the pixels of the whole transmission image of the value document as an edge brightness value. This embodiment is advantageous in particular when the value document of the given value document type has a lower transmission in the employed wavelength region, for example in the visible wavelength region or a lower infrared transmission in all regions except for the edge of the see-through window. In particular, the edge brightness value can be ascertained very fast, brightness maxima over columns or lines of the transmission image are already available. The exact position of the see-through window does not need to be ascertained then.

According to a second alternative, a region of the transmission image showing the at least one see-through window with its edge may be ascertained, and as an edge brightness value the maximum of the brightnesses of at least two of the pixels of at least the edge of the image of the see-through window is employed. However, it is also possible that the maximum of the brightnesses of the region of the transmission image is ascertained and employed as an edge brightness value. The evaluation device of the apparatus may then preferably be configured to ascertain a region of the transmission image which shows the at least one see-through window with its edge, and to employ as an edge brightness value the maximum of the brightnesses of at least two of the pixels of at least the edge of the see-through window, or it may be configured to ascertain the maximum of the brightnesses of the region of the image and to employ it as the edge brightness value. The form and size of the region and, optionally, also the position of the region on the value document may preferably be specified for a respective value document type and selected in particular in such a way that it encloses the see-through window and its edge in the transmission image or an edge region of suitable width around the see-through window. For ascertaining the region, the value document type of the value document may be ascertained beforehand. The edge brightness values ascertained in this way have turned out to be particularly favorable for ascertaining the threshold value.

If the value document has several see-through windows, as an edge brightness value there may preferably be employed the mean value or particularly preferably the maximum of the edge brightness values of the several see-through windows. The evaluation device may then be configured accordingly.

The edge brightness value is employed for ascertaining the threshold value. The threshold value here is smaller than the ascertained edge brightness value, but greater than the minimum brightness in the transmission image. Preferably, the threshold value is ascertained such that it is greater than a mean value over the brightnesses of the pixels in at least one specified part of the transmission image or a mean value over the brightnesses of the pixels of the transmission image of the whole value document. The evaluation device of the apparatus is then preferably configured to ascertain the threshold value in such a way that it is greater than a mean value over the brightnesses of the pixels in at least one specified part of the transmission image or a mean value over the brightnesses of the pixels of the transmission image of the whole value document. This results in a more reliable recognition of print removals. This is in particular the case with the preferred embodiment of the method, in which the specified part of the transmission image does not show the see-through window and the edge of the see-through window.

If upon the search for pixels which lie in at least one specified portion of the transmission image and outside the see-through window and its edge and which have a brightness that lies over the threshold value there are ascertained or found pixels having brightnesses beyond the threshold value, these represent places on the value document which have a print removal. The specified portion may preferably comprise the whole value document without a specified region which includes the see-through window and its edge. If the value document has several see-through windows, the specified portion may preferably comprise the whole value document without specified regions which respectively include a see-through window and its respective edge. The region or the regions are particularly preferably chosen such that their area is respectively not or maximally 10% greater than the area of the see-through window and its edge.

Preferably, the pixels found during the search which lie within the specified portion of the transmission image and outside the see-through window and its edge and which have a brightness which lies above the threshold value are marked as deviation pixels. The evaluation device may then be configured to mark the pixels found during the search which lie within the specified portion of the transmission image and outside the see-through window and its edge and which have a brightness which lies above the threshold value as deviation pixels. This may simplify the further examination of possible print removals. The marking may be effected, for example, by storing suitable data or the movement of pixel data describing the pixels to other storage areas.

In dependence on the result of the search, at least one signal may then be formed and/or at least one datum may be stored which represents the result of the search.

In principle, it may be sufficient to only check whether in the specified portion there were found pixels whose brightness exceeds the threshold value. Preferably, it is ascertained how many pixels were found upon the search. In the apparatus, the evaluation device may then preferably be configured to ascertain how many pixels were found upon the search. Preferably, a corresponding value can then be stored.

Further, preferably a local distribution of the pixels found upon searching may be ascertained, i.e. of those pixels of the transmission image which lie in the specified portion and outside the see-through window and its edge and whose brightness lies above the threshold value. The evaluation device of the apparatus may then preferably be configured to ascertain a local distribution of the pixels found upon searching, i.e. of those pixels of the transmission image which lie in the specified portion and whose brightness lies above the threshold value. Particularly preferably, for example, upon ascertaining the local distribution of the pixels found upon searching there may be ascertained sets of deviation pixels in which two of the pixels of the same set in each case are neighboring. In the apparatus, particularly preferably the evaluation device may then be configured to ascertain, upon ascertaining the local distribution of the pixels found upon searching, sets of deviation pixels in which two of the pixels of the same set in each case are neighboring in the transmission image. Pixels neighboring in the transmission image are understood here to be preferably pixels which are directly or nearest neighboring in the transmission image, thus having a minimal distance from each other. However, it is also possible that pixels neighboring in the transmission image are understood to be pixels which are the next or next but one neighbors. Then the number of sets and for each of the sets the number of the pixels therein and/or the area corresponding to the pixels may be ascertained.

Further, it is preferred that in dependence on the result of the search, preferably in dependence on the ascertained number and/or the ascertained local distribution of the pixels found upon the search, a state value is ascertained for the value document. The evaluation device of the apparatus may then preferably be configured to ascertain a state value for the value document in dependence on the result of the search, preferably in dependence on the ascertained number and/or the ascertained local distribution of the pixels found upon the search. Preferably, the state value may represent an indication of the presence of a print removal and be stored. The pixels found upon the search are again those of the pixels of the transmission image which lie in the specified portion and outside the at least one see-through window and its edge and whose brightness lies above the threshold value. Particularly preferably, the above-mentioned number of sets and the maximum number of the pixels of the sets may be employed upon ascertaining the state value. This allows a particularly good statement on the degree of the damage of the value document or its fitness for circulation, i.e. the suitability for further use in the monetary cycle. Upon ascertaining the state value there may also be employed results of other checks of the value document.

Subject matter of the invention is further an apparatus for processing value documents with a feeding device for feeding value documents, an output device for receiving processed, i.e. sorted value documents, and a transport device for transporting singled value documents from the feeding device to the output device. The apparatus further comprises an apparatus according to the invention for checking the transported value documents.

BRIEF DESCRIPTION OF THE DRAWINGS

The invention will hereinafter be explained further by way of example with reference to the drawings, in which.

DETAILED DESCRIPTION OF VARIOUS EMBODIMENTS

Figure 1:
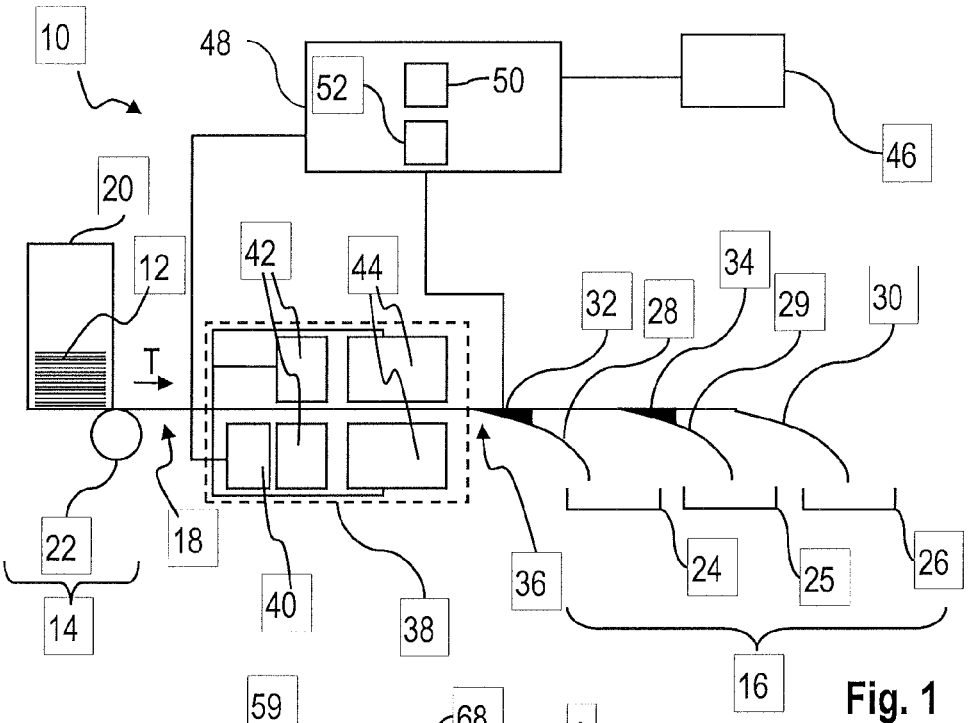
FIG. 1 shows a schematic view of a value-document processing apparatus in the form of a bank-note sorting apparatus.

A value-document processing apparatus 10 in FIG. 1, in the example an apparatus for processing value documents 12 in the form of bank notes, is configured for sorting value documents in dependence on the recognition of the authenticity and of the state of processed value documents. The components of the apparatus described in the following are arranged in a housing (not shown) of the apparatus or are held at this, unless they are referred to as external.

The apparatus has a feeding device 14 for feeding value documents, an output device 16 for receiving processed, i.e. sorted value documents, and a transport device 18 for transporting singled value documents from the feeding device 14 to the output device 16.

The feeding device 14 comprises, in the example, an input pocket 20 for a value-document stack and a singler 27 for singling value documents from the value-document stack in the input pocket 20 and for feeding the singled value documents to the transport device 18.

The output device 16 has, in the example, three output portions 24, 25 and 26 into which processed value documents can be sorted, sorted according to the result of the processing. In the example, each of the portions has a stack pocket and a stacking wheel (not shown) by means of which fed value documents can be deposited in the stack pocket. In other embodiment examples one of the output portions may be replaced by a device for destroying bank notes.

The transport device 18 has at least two, in the example three, branches 28, 29 and 30 at whose ends one of the output portions 24 or 25 or 26 is disposed respectively, and, at the branching points, gates 32 and 34 controllable by actuating signals for feeding value documents to the branches 28 to 30 and thus to the output portions 24 to 26 in dependence on actuating signals.

On a transport path 36, defined by the transport device 18, between the feeding device 14, in the example more precisely the singler 22, and the first gate 32 after the singler 22 in the transport direction there is disposed a sensor device 38 which measures physical properties of the value documents when value documents are being transported past, and forms sensor signals representing the measurement results. In this example, the sensor device 38 has three sensors, namely an optical remission sensor 40 which captures a remission color image and a remission IR image of the value document, an optical transmission sensor 42 which captures a transmission color image and a transmission IR image of the value document, and a transmission ultrasound sensor 44 which captures or measures as ultrasound property the ultrasound transmission of the value document in locally resolved fashion and will hereinafter only be referred to as an ultrasound sensor for simplicity's sake. The sensor signals formed by the sensors correspond to measurement data or raw data of the sensors, which, depending on the sensor, could already have been subjected to a correction, for example in dependence on calibrating data and/or noise properties.

For the capture and display of operating data, the value-document processing apparatus 10 has an input/output device 46. The input/output device 46 is implemented, in the example, by a touch-sensitive display device ("touch screen"). In other embodiment examples, it may comprise, for example, a keyboard and a display device, for example an LCD display.

A control and evaluation device 48 is connected via signal connections to the sensor device 38, the input/output device 46 and the transport device 18, in particular the gates 32 and 34.

The control and evaluation device 48 forms a data processing device and has, besides corresponding data interfaces (not shown in the Figures) for the sensor device 38 or the sensors thereof, a processor 50 and a memory 52 connected to the processor 50 in which at least one computer program with program code is stored. Upon the execution of the computer program, the control and evaluation device 48 or the processor 50 evaluates the signals or measurement values of the sensor device 38 and controls the apparatus according to the properties of the value documents. Thus, in its function as an evaluation device it can evaluate the sensor signals, in particular for ascertaining an authenticity class and/or a state class of a processed value document, and in its function as a control device it can drive the transport device 18 in accordance with the evaluation and optionally store the measurement data. In other embodiment examples there can also be provided an evaluation device separate from the control device, which is connected via interfaces to the sensors of the sensor device 38, on the one hand, and the control device, on the other hand. The evaluation device is then configured for analysing the sensor signals and delivers the respective result to the control device which drives the transport device. The evaluation operations described in the following can then be carried out by the evaluation device alone.

Further, the control and evaluation device 48 drives the input/output device 46 such, among other things, that it displays operating data, and captures via these operating data which correspond to inputs of an operator.

In operation, value documents are singled from the feeding device and transported past or through the sensor device 38. The sensor device 38 captures or measures physical properties of the value document respectively transported past or through it and forms sensor signals or measurement data which describe the measurement values for the physical properties. The control and evaluation device 48 classifies the value document in dependence on the sensor signals of the sensor device 38 for a value document and on classification parameters stored in the evaluation device into one of specified authenticity and/or state classes, and by emitting actuating signals drives the transport device 18, here more precisely the gates 32 or 34, such that the value document is output, corresponding to its class ascertained upon the classification, into an output portion of the output device 16 which is associated with the class. The association with one of the specified authenticity classes or the classification is effected here in dependence on at least one specified authenticity criterion.

For the check of value documents hereinafter described in more detail, in particular infrared transmission images captured by the transmission sensor 42 are employed. The transmission sensor 42 has a illumination portion by means of which a specified capture region of the transport path may be illuminated with optical radiation in the visible and in a specified infrared wavelength region. On the opposite side of the transport path 18, the transmission sensor 42 has a detection device for the locally resolved capture of a color image in the wavelength region of the visible light and an infrared transmission image in the specified infrared wavelength region.

The transmission sensor 42 is configured as a line sensor which during the transport of the value document through the sensor successively captures transmission line images from value document stripes extending transverse to the transport direction of the value document. Accordingly, the detection device comprises detector lines. The transmission sensor 42 joins the captured line images into digital transmission images which comprise pixels whose properties are described by pixel data. In particular, it captures a digital infrared transmission image of the value document forming pixel data describing the pixels of the image and transmitting these to the evaluation device 48. The pixel data for a pixel describe in particular a brightness which describes the intensity for the pixel, which intensity was received by the detection device.

Figure 2:
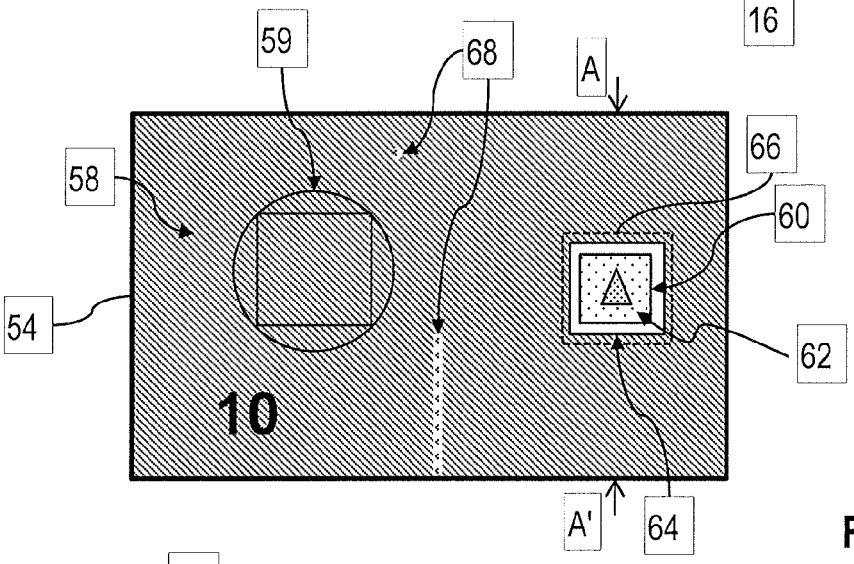
FIG. 2 shows a schematic representation of an infrared transmission image of a value document having a polymer substrate and at least one see-through window, which is capturable for a value document by the apparatus of FIG. 1.
Figure 3:
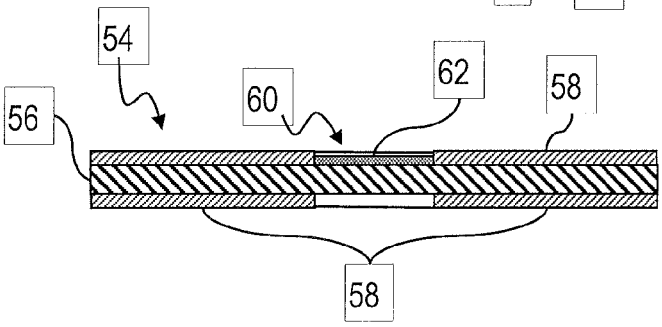
FIG. 3 shows a schematic view of a section along the line of A-A' through the value document on which the transmission image of FIG. 2 is based.

In the hereinafter described embodiment example, value documents of specified value document types are checked, which have a polymer substrate and a see-through window. An example of such a value document of one of these specified value document types and the infrared transmission image thereof is shown in the FIGS. 3 and 2. FIG. 2 schematically shows the infrared transmission image of the value document 54, FIG. 3 shows a schematic sectional view along the line A-A' of FIG. 2.

The value document 54 has a sheet-shaped transparent polymer substrate 56 as a carrier which carries on both surfaces areally applied cover layers 58 which have an opacity comparable to the opacity of bank notes paper or greater at least in the visible wavelength region. These cover layers are hatched in the Figures. On this layer there is printed with a suitable printing ink a printed image 59, which is indicated only schematically in FIG. 2.

Further, the value document 54 has a see-through window 60. The see-through window 60 is formed, inter alia, in that no areal cover layer is present in the region thereof. The cover layers 58 thus extend over the whole value document except for the see-through window 60. In the present example, in the see-through window there is located one more print 62 with a transparent printing ink, which is represented in dotted lines in FIG. 2. Further, the print comprises cover layer material applied by halftone printing, which in the example of FIG. 2 forms a triangle.

In an infrared transmission image, schematically shown in FIG. 2, captured with the transmission sensor 42 besides the mentioned elements there is shown an edge 64 which encloses the see-through window 60. This edge 64 is characterized by a particularly high receiving intensity or brightness which is probably due to a scattered radiation, because it corresponds to an edge region around the see-through window which still has areal cover layer. The thickness of this cover layer or, when several cover layers arranged one above the other are employed, their number may deviate from the thickness or number in the other regions of the value document 54.

FIG. 2 further shows two regions 68 corresponding to print removals, i.e. regions in which the cover layers 58, optionally with print, are rubbed off or chipped off.

Figure 4:
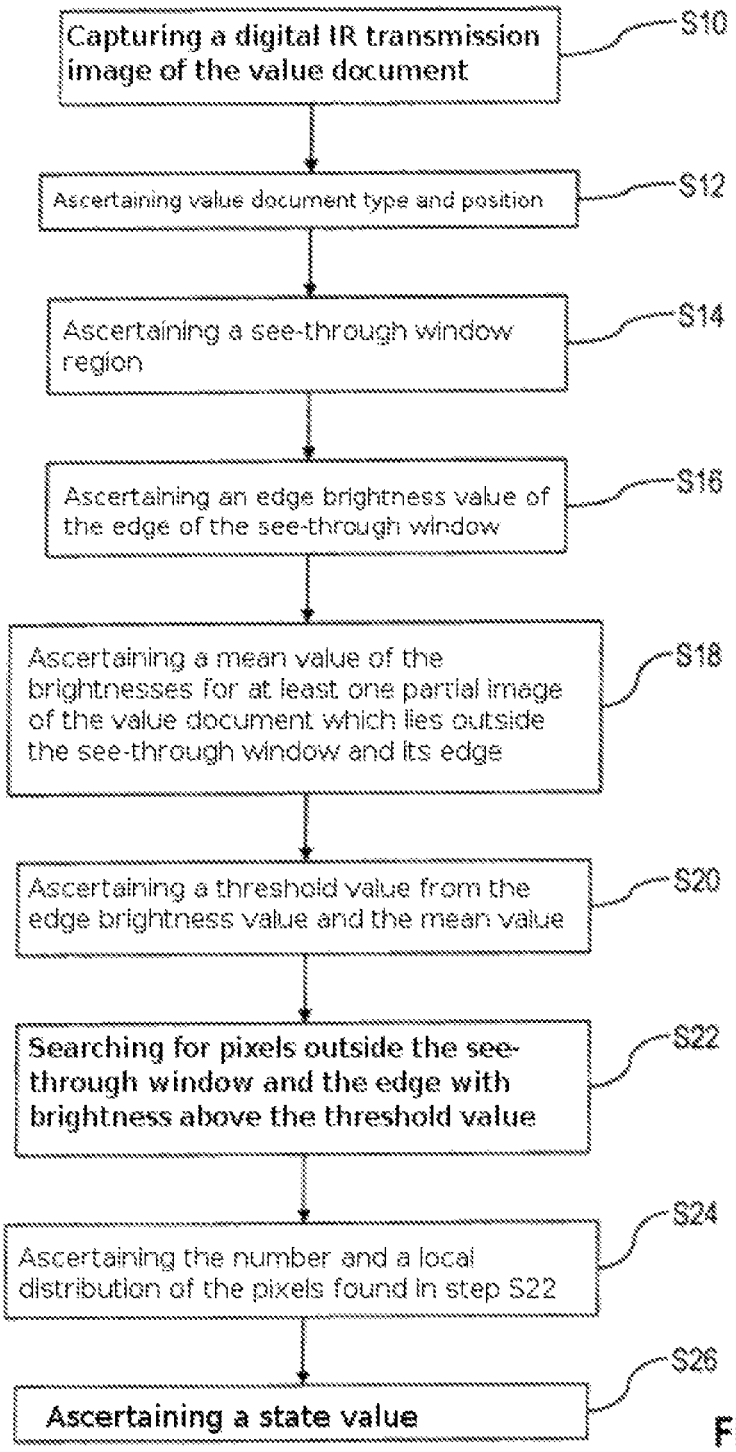
FIG. 4 shows a simplified flowchart of a first embodiment of a method for checking a value document having a see-through window, which can be carried out by means of the apparatus of FIG. 1.

The first embodiment example of a method for checking a value document having a polymer substrate and at least one see-through window, in particular for the presence of at least one print removal is roughly outlined, at least in parts, in FIG. 4 in the form of a flowchart. For carrying out the method, in the control and evaluation device 48, more precisely the memory 52 thereof, there is stored a computer program upon the execution of which the control and evaluation device 48, more precisely the processor 50, executes the first embodiment of the method.

In step S10, at first a digital infrared transmission image of a value document transported through the transmission sensor 42 is captured by means of the transmission sensor 42. The transmission sensor 42 captures, as described above, optical radiation emanating from the value document, in particular in the specified infrared wavelength region, and forms the corresponding measuring signals representing captured intensities. From these there are formed pixel data for pixels of a digital infrared image of a value document, which are captured by the control and evaluation device 48.

In step S12, the control and evaluation device 48 ascertains, using a color image of the value document captured by means of the remission sensor 40, the value document type and position thereof. In doing so, as a value document type the currency and the face value of the value document are ascertained, as a position there is ascertained one of the four possible orientations of the value document in the transport path which are obtainable by rotation of the value document around axes parallel and transverse to the transport direction.

In step S14, the control and evaluation device 48 ascertains for the see-through window 60 in the captured infrared transmission image, in dependence on the ascertained value document type and the position of the value document, a region or see-through window region 66 (cf. FIG. 2) specified for the value document type and the position. This region is chosen such that the see-through window 60 and its edges 64, taking into account possible variations upon its manufacture, lie with a specified certainty within the region 66, its size, however, being as small as possible under this condition. In particular, it shows the see-through window 60 with its edge 64.

In step S16, the control and evaluation device 48 ascertains an edge brightness value of the edge 64 of the see-through window 60. In the present embodiment example, for this purpose the control and evaluation device 48 ascertains the maximum of the brightnesses of the pixels of the region 66 of the infrared transmission image and stores the maximum as an edge brightness value.

In step S18, the control and evaluation device 48 calculates a mean value of the brightnesses in a specified part of the transmission image. In the present example, this part is the whole transmission image except for the region 66 or without the region 66.

In step S20, the control and evaluation device 48 then ascertains a threshold value for the recognition of a print removal, which is smaller than the edge brightness value but greater than the minimum brightness in the transmission image. For value documents of the value document type being present here, the brightnesses lie, on account of the design in the region 66, always above the minimum brightness in the remaining transmission image, if no print removals are present. More precisely, the control and evaluation device 48 hence defines the threshold value such that it is greater than the mean value ascertained in step S18. In this example, the threshold value is a weighted mean value from the edge brightness value and the mean value, the weighting factor being specified for the value document type. This is determinable, for example, by an examination of specified reference value documents of the specified value document type having print removals.

In step S22, the control and evaluation device 48 searches for pixels which lie in at least one specified portion of the transmission image and outside the at least one see-through window and its edge and have a brightness which lies above the threshold value. As a specified portion there is employed here the whole transmission image except for the region 66 which was employed for ascertaining the edge brightness value.

Upon this search the control and evaluation device 48 marks the found pixels whose brightness exceeds the threshold value as deviation pixels. For marking, in this example, identifiers of the pixels which represent the place are stored.

In step S24, the control and evaluation device 48 ascertains, on the one hand, the number of deviation pixels ascertained in step S22 and stores a corresponding value. On the other hand, it ascertains a local distribution of the pixels found in step S22. For this purpose, it ascertains sets of deviation pixels in which two of the pixels of the same set in each case are neighboring. For this purpose there can be utilized, among other things, methods referred to as "blob labelling" algorithms. In this embodiment example, neighboring pixels are pixels with a minimum distance from each other. The pixels of the sets such ascertained respectively form coherent regions in the transmission image, i.e. from each pixel of a respective set there leads a way via neighboring pixels to any other pixel of the respective set. Each of these sets can thus represent a print removal. The control and evaluation device 48 then calculates the number of the sets found in such a way and the number of the pixels, i.e. deviation pixels, in these sets. The number of the sets and the numbers of the pixels are stored.

Figure 5:
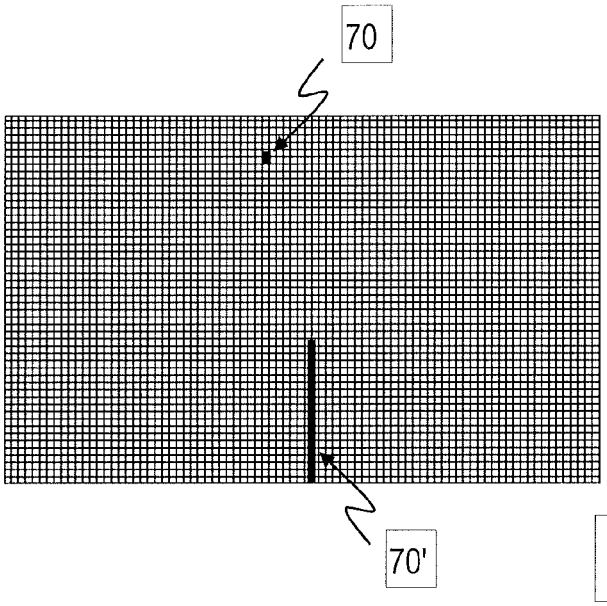
FIG. 5 shows a schematic representation of the positions of deviation pixels in the image of FIG. 2.

FIG. 5 schematically shows pixels of the transmission image of FIG. 2. Pixels not recognized as deviation pixels are represented as squares filled with white and deviation pixels as squares filled with black. It is easy to recognize that two sets 70 and 70' of coherent deviation pixels were recognized, which respectively have different pixel numbers. These sets exactly correspond to the regions 68 having print removals.

In step S26, the control and evaluation device 48 then ascertains in dependence on the ascertained number of deviation pixels, the number of the ascertained sets and the number of pixels in the sets a state value which indicates whether or not the value document is still further usable or fit for circulation. For this purpose, the control and evaluation device 48 may compare the number of deviation pixels with a permissible maximum number and the number of sets in proportion to the number of totally ascertained deviation pixels with a specified limit value. In some embodiment examples this state value may represent, whether or not at least one print removal is present.

In dependence on the ascertained state value the control and evaluation device 48 may then drive the transport device 18, as described above. In other embodiment examples, state values additionally ascertained using the remission sensor and using the ultrasound sensor may be taken into account upon driving.

The second embodiment example differs from the preceding embodiment example only in that the step S16 is replaced by a step S16'. The control and evaluation device 48 or the computer program therein is then changed accordingly. All the other steps and components are unchanged.

The step S16' differs from the step S16 in that as an edge brightness value the maximum of the brightnesses of the pixels of the whole transmission image is ascertained. In doing so, it is exploited that the design of the value documents of the specified value document type does not provide regions in which the transmission is greater than that of the edge 64.

The third embodiment example differs from the first embodiment example only in that the step 16 is replaced by a step S16". The control and evaluation device 48 or the computer program therein is then changed accordingly. All the other steps and components are unchanged.

The step S16" differs from the step S16 only in that the region 66 is replaced by a strip-shaped region 66' extending in the transmission image transverse to the transport direction of the value document and running from one edge of the value document to the opposite edge of the value document. This region 66' is further chosen such that the see-through window 60 and its edges 64, taking into account possible variations upon its manufacture, lie with a specified certainty within the region 66', whereas its size, however, is as small as possible under this condition. In particular, it shows the see-through window 60 with its edge 64.

Yet a further embodiment example differs from the first embodiment example only in that step S16 is replaced by a step S16'". The control and evaluation device 48 or the computer program therein is then changed accordingly. All the other steps and components are unchanged.

The step S16'" differs from the step S16 in that as an edge brightness value there is employed the mean value of the brightnesses of at least two of the pixels of at least the edge. More precisely, there is specified a number N, for example of 10 or 20, and the N greatest brightnesses are ascertained in region 66, which according to the design of the value document of the specified value document type corresponds to the N greatest brightnesses of the edge 64. The mean value over the N greatest brightnesses is now employed as an edge brightness value.

Yet a further embodiment example differs from the first embodiment example in that in step S16 at first the pixels in the edge 64 are ascertained and then the maximum of the brightnesses of only the ascertained pixels of the edge is employed as an edge brightness value.

Further embodiment examples may differ from the above-described embodiment examples in that value documents of a value document type are checked which have least two see-through windows but are constructed analogously to the above-described value documents.

The step S14 is then modified to the effect that for the at least two see-through windows there is respectively ascertained a see-through window region which corresponds to the region 66 of the first embodiment example.

For ascertaining the edge brightness, for all see-through windows an edge brightness value for the respective see-through window may now be ascertained analogously to the preceding embodiment examples. As an edge brightness value there may then be employed one of the edge brightness values, the maximum of the edge brightness values ascertained for the individual see-through windows, or a mean value of the edge brightness values ascertained for the individual see-through windows. The following steps then differ from the steps of the above-described embodiments in that for ascertaining the mean value of the brightnesses and for searching deviation pixels there are employed regions of the value document or parts of the transmission image which comprise or show none of the see-through windows and none of the edges of the see-through windows.

Further embodiment examples differ from the previously described embodiment examples in that instead of the infrared transmission images transmission images in a specified visible wavelength region are employed. Preferably, the transmission color image captured by the transmission sensor 42, more precisely the green image thereof, may be employed.

This invention claimed is:

1. A method for checking a value document for the presence of print removals, said value document having a polymer substrate and at least one see-through window, the method comprising the steps of:

capturing a digital transmission image of the value document, the transmission image comprising pixels;

ascertaining in the image an edge brightness value that indicates the brightness of an edge of the at least one see-through window;

using the edge brightness value, ascertaining a threshold value for the brightness of pixels, said threshold value being suited to determine whether there is an indication of the presence of a print removal, said threshold being smaller than the edge brightness value but greater than the minimal brightness in the image;

searching pixels which lie in at least one specified portion of the image and outside the at least one see-through window and its edge and have a brightness which lies above the threshold value; and in dependence of the result of the searching, forming at least one signal and/or storing at least one datum which represents the result of the searching.

2. The method according to claim 1, wherein the digital transmission image is a digital infrared transmission image.

3. The method according to claim 1, further comprising the step of ascertaining an edge brightness value the maximum of the brightnesses of the pixels of the whole transmission image.

4. The method according to claim 1, further comprising the steps of:

ascertaining a region of the image showing the see-through window with its edge; and employing as an edge brightness value the mean value or the maximum of the brightnesses of at least two of the pixels of at least the edge of the image of the see-through window, or ascertaining the maximum of the brightnesses of the region of the image; and employing the mean value or the maximum of the brightnesses of the region of the image as an edge brightness value.

5. The method according to claim 4, wherein the specified part of the image does not show the edge of the see-through window and the see-through window.

6. The method according to claim 5, further comprising the step of ascertaining a local distribution of the pixels found upon the search whose brightness lies above the threshold value.

7. The method according to claim 1, further comprising the step of ascertaining the threshold value such that it is greater than a mean value over the brightnesses of the pixels in at least one specified part of the image or the pixels of the image of the whole value document.

8. The method according to claim 1, further comprising the step of ascertaining how many pixels were found upon the search.

9. The method according to claim 1, further comprising the step of ascertaining in dependence on the result of the search in dependence on the number and/or the local distribution of the pixels found upon the search a state value for the value document.

10. An apparatus for checking a value document for the presence of print removals, said value document having a polymer substrate and a see-through window, with an evaluation device which is configured for executing a method comprising the steps of:

capturing a digital transmission image of the value document, the transmission image comprising pixels;

ascertaining in the image an edge brightness value that indicates the brightness of an edge of the at least one see-through window;

using the edge brightness value, ascertaining a threshold value for the brightness of pixels, said threshold value being suited to determine whether there is an indication of the presence of a print removal, said threshold being smaller than the edge brightness value but greater than the minimal brightness in the image;

searching pixels which lie in at least one specified portion of the image and outside the at least one see-through window and its edge and have a brightness which lies above the threshold value;

in dependence of the result of the searching, forming at least one signal and/or storing at least one datum which represents the result of the searching.

11. The apparatus according to claim 10, further comprising an optical transmission sensor for capturing a digital transmission image of the value document which is coupled to the evaluation device, and in which the evaluation device is configured to capture an image of the transmission sensor as a digital image.

12. The apparatus according to claim 11, wherein the optical transmission sensor comprises an optical transmission sensor for capturing a digital transmission image of the value document.

13. A data processing device comprising a physical data carrier which has a program code, upon the execution of which the data processing device executes a method for checking a value document for the presence of print removals, said value document having a polymer substrate and at least one see-through window, the method comprising the steps of:

capturing a digital transmission image of the value document, the transmission image comprising pixels;

ascertaining in the image an edge brightness value that indicates the brightness of an edge of the at least one see-through window;

using the edge brightness value, ascertaining a threshold value for the brightness of pixels, said threshold value being suited to determine whether there is an indication of the presence of a print removal, said threshold being smaller than the edge brightness value but greater than the minimal brightness in the image;

searching pixels which lie in at least one specified portion of the image and outside the at least one see-through window and its edge and have a brightness which lies above the threshold value; and in dependence of the result of the searching, forming at least one signal and/or storing at least one datum which represents the result of the searching.

14. A physical data carrier which is readable by means of a data processing device and on which a computer program according to claim 13, is stored.

* * * * *